US008474165B1

(12) United States Patent
Hill et al.

(10) Patent No.: US 8,474,165 B1
(45) Date of Patent: Jul. 2, 2013

(54) FORM ASSEMBLY FOR REMOVABLY ATTACHING A FORM TO A SURFACE

(75) Inventors: Agostino S. Hill, Portland, OR (US); Richard E. Ipsen, Tualatin, OR (US)

(73) Assignee: Reynolds and Reynolds Holdings, Inc., Dayton, OH (US)

( * ) Notice: Subject to any disclaimer, the term of this patent is extended or adjusted under 35 U.S.C. 154(b) by 715 days.

(21) Appl. No.: 12/271,205

(22) Filed: Nov. 14, 2008

(51) Int. Cl.
*G09F 7/12* (2006.01)

(52) U.S. Cl.
USPC ..... 40/594; 40/593; 283/103

(58) Field of Classification Search
USPC ..... 40/594, 593; 283/103; 428/42.2, 428/43
See application file for complete search history.

(56) References Cited

U.S. PATENT DOCUMENTS 4,348,440 A * 9/1982 Kriozere ..... 428/42.2
4,864,755 A * 9/1989 Owens ..... 40/594
4,889,754 A * 12/1989 Vargas ..... 428/41.4
4,907,359 A 3/1990 Berman
D322,627 S 12/1991 Sisilli
D322,807 S 12/1991 Sisilli
D322,809 S 12/1991 Sisilli
5,167,739 A * 12/1992 Hutchinson et al. ..... 156/64
D342,967 S 1/1994 Sisilli
D343,416 S 1/1994 Sisilli
5,290,067 A * 3/1994 Langen ..... 283/60.1
5,318,325 A 6/1994 Ipsen
5,466,502 A * 11/1995 Wilkinson et al. ..... 428/42.1
5,487,568 A 1/1996 Ipsen
D375,121 S 10/1996 Sisilli
D375,122 S 10/1996 Sisilli
D376,386 S 12/1996 Sisilli
D376,816 S 12/1996 Sisilli
5,597,635 A * 1/1997 Pusl et al. ..... 428/42.2
D382,896 S 8/1997 Sisilli
5,697,518 A * 12/1997 Callahan, Jr. ..... 221/34
5,779,543 A 7/1998 Sisilli
D460,782 S 7/2002 Hudson
6,418,649 B1 * 7/2002 Bolon ..... 40/360

* cited by examiner

*Primary Examiner* — Gary Hoge
(74) *Attorney, Agent, or Firm* — Adolph Locklar

(57) ABSTRACT

A form assembly for removably attaching a form to a surface includes a form including a page, the page including a body, a first detachable stub attached to a first edge of the body by a first detachment line and a second detachable stub attached to a second edge of the body opposite the first edge by a second detachment line. The form also includes a first adhesive label including a lite-tac adhesive, attached to the first detachable stub by the lite-tac adhesive, where the lite-tac adhesive does not overlap the first detachment line, and a second adhesive label including a lite-tac adhesive, attached to the second detachable stub by the lite-tac adhesive, where the lite-tac adhesive does not overlap the second detachment line. The lite-tac adhesive of the first adhesive label and the lite-tac adhesive of the second adhesive label can removably secure the form assembly to a surface.

23 Claims, 11 Drawing Sheets

FORM ASSEMBLY FOR REMOVABLY ATTACHING A FORM TO A SURFACE

BACKGROUND

Some situations require forms, for example, two-sided forms, to be attached to surfaces such as a window interior in such a way that the form will remain reliably in place, but still be easy to remove while leaving behind as little adhesive residue as possible. For example, The Federal Trade Commission's Used Car Rule may require Buyers Guides be attached to used cars. Car dealers may prefer to attach to the Buyers Guides to the window interiors of cars on their lots. The Buyers Guides may need to remain in place on the window even if the window is rolled up and down. Once the car is sold the Buyers Guides may need to be removed, keeping the informational portion of the Buyers Guides intact so it can be used at the closing of the sale. The window may need to be free of any adhesive residue before the buyer takes possession of the car.

Adhesives, such as various types of glue, may be applied directly to a form, for example along two opposite sides, just on the corners, or along all sides of the form. The form may then be attached to a surface. Applying adhesive to all sides of the form may reliably secure the form to the surface, but may make removal of the form difficult, for example, resulting in destruction of the form. Applying adhesive only to two opposite sides of the form, or to only the corners of the form, may make the form easier to remove, but may be less reliable at holding the form in place. For example, a form secured to a car window with adhesive on only two sides may become crumpled when the window is rolled down and back up. In either case, the adhesive used to secure the form may leave hard-to-remove residue on the surface.

Another approach may involve the use of adhesives that are not applied directly to the form itself. For example, a form may be printed onto a liner attached to an adhesive label. The form may be printed on the liner so as to leave a border of unprinted space on the liner around the form. This unprinted part of the liner may be removed, for example, through the use of kiss-cutting, exposing the portion of the adhesive label that was behind the now-removed portion of the liner. The form may then be attached to the surface using the exposed adhesive. This approach may hold the form to the surface securely, but may also leave behind hard-to-remove residue. Further, because the form is printed on liner attached to the adhesive label, the non-exposed adhesive is used only to hold the form, and not to attach the form to the surface. The result is wasted materials, as far more adhesive is devoted to holding the form to the adhesive label than to attaching the form to the surface, rendering this approach not cost-effective for any significant quantity of forms.

A third approach may make use of an adhesive label with a liner around the edges, leaving the center open. A form, such as a multi-part form, may be attached to the center of the adhesive label. The liner may then be peeled away from the edges of the label, exposing adhesive that may be used to attach the adhesive label, with the form attached to it, to a surface. The form may be held securely to the surface, but may be hard to remove. Because the form is attached directly to the adhesive label, the portion of the form attached to the adhesive may not be usable once the adhesive label is removed from the surface, meaning that to obtain one usable page, the form will have to have two pages, resulting in wasted materials.

BRIEF DESCRIPTION OF THE FIGURES

The utility of the embodiments will be readily appreciated and understood from consideration of the following description of the embodiments when viewed in connection with the accompanying drawings.

DESCRIPTION

Various embodiments provide a form assembly and method of manufacturing a form assembly for removably attaching a form to a surface. A form assembly for removably attaching a form to a surface may include a form including a page, the page may including a body, a first detachable stub attached to a first edge of the body by a first detachment line and a second detachable stub attached to a second edge of the body opposite the first edge by a second detachment line. The form may also include a first adhesive label including a lite-tac adhesive, attached to the first detachable stub by the lite-tac adhesive, where the lite-tac adhesive does not overlap the first detachment line, and a second adhesive label including a lite-tac adhesive, attached to the second detachable stub by the lite-tac adhesive, where the lite-tac adhesive does not overlap the second detachment line. The lite-tac adhesive of the first adhesive label and the lite-tac adhesive of the second adhesive label may be able to removably secure the form assembly to a surface.

Figure 1:
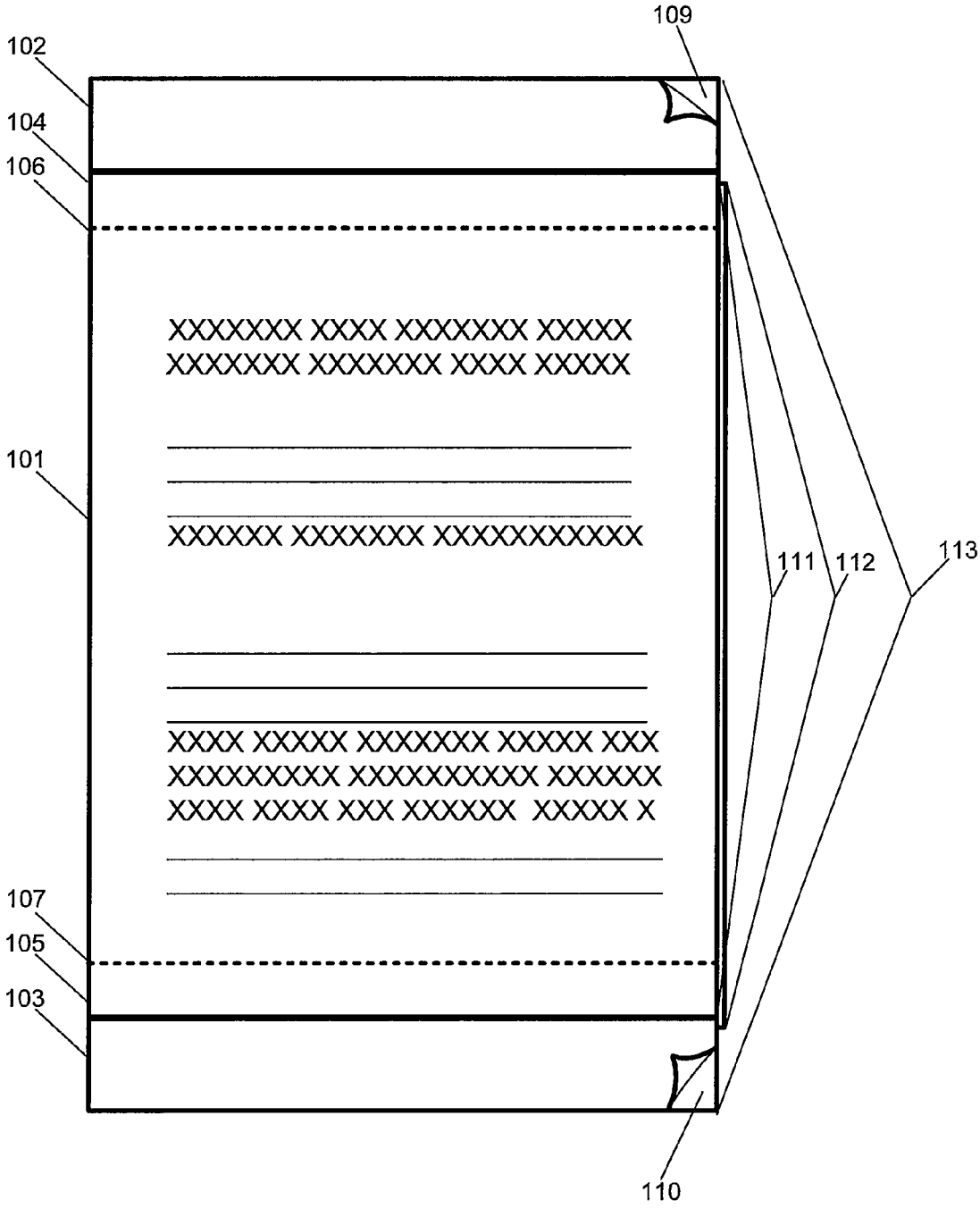
FIG. 1 depicts an exemplary form assembly for removably attaching a form to a surface.
Figure 2:
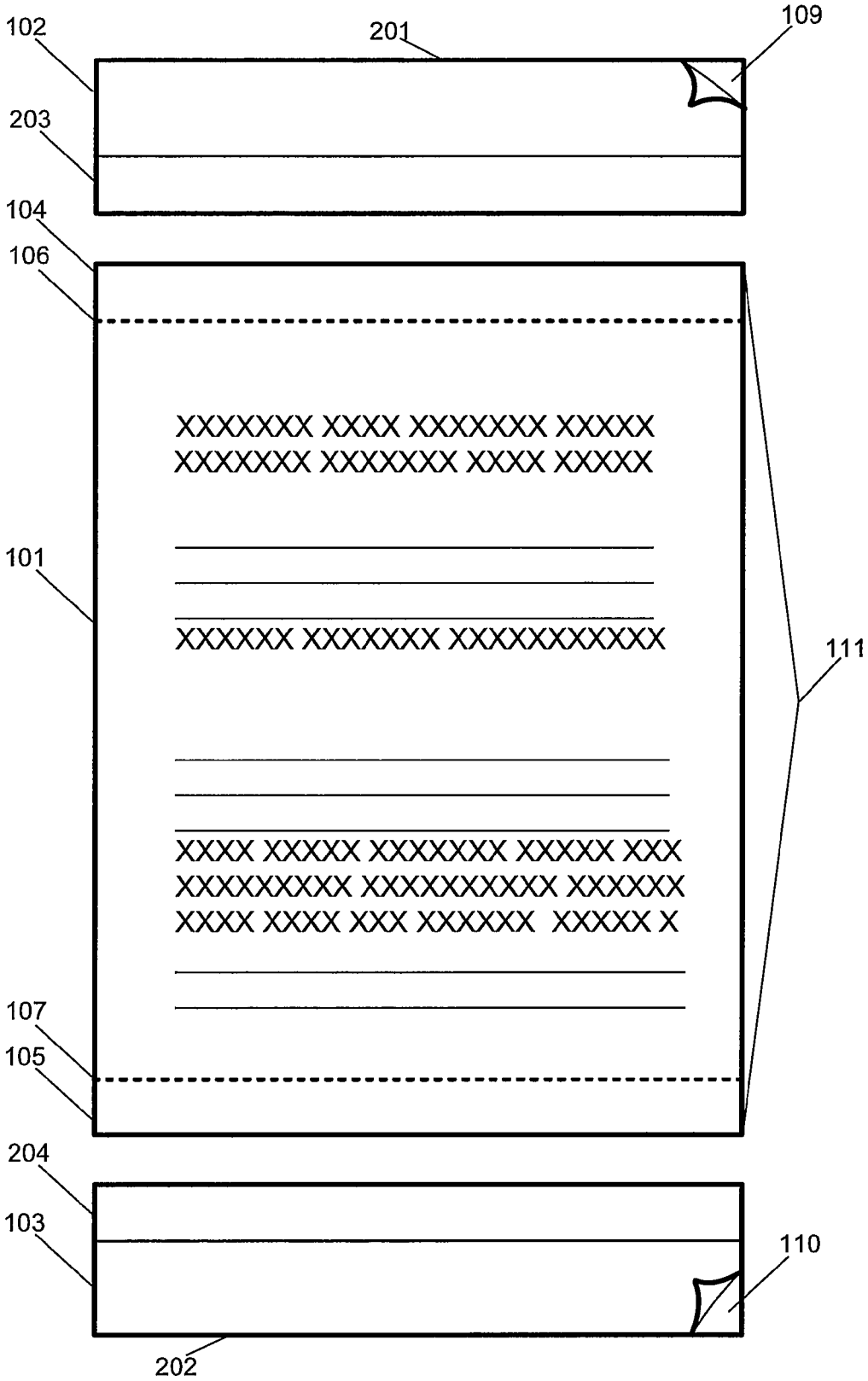
FIG. 2 depicts an exemplary form assembly prior to being assembled.

FIG. 1 depicts an exemplary form assembly for removably attaching a form to a surface. FIG. 2 depicts an exemplary form assembly prior to being assembled. A form assembly 113 may include a form 112, a first adhesive label 201, and a second adhesive label 202.

The form 112 may be any suitable form. The form 112 may include one or more pages 111, joined together in any suitable manner. For example, the form 112 may be a one-page form, having a single page 111, or the form 112 may be a multi-page form, having multiple pages 111. If the form 112 has multiple pages 111, each page 111 may be made of a different material. For example, an exemplary multi-page form 112 may have a first exemplary page 111 of standard stock letter sized paper on which an order sheet is printed, a second exemplary page 111 that is carbon paper, and a third exemplary page 111 that is identical to the first exemplary page 111, for creating a carbon copy of the first exemplary page 111.

The page 111 may be a single sheet of any suitable size and material for use in the form 112. For example, the page 111 may be standard stock letter sized paper, carbon paper, carbon copy paper, a peel away label attached to an adhesive liner, etc. The page 111 may include a body 101, a first detachable stub 104, and a second detachable stub 105.

The body 101 of the page 111 may be the functional portion of the page 111. If the page 111 contains information, the information may be included in the body 101. The information may be written, printed, or otherwise indicated on the body 101. If the page 111 is used for making a carbon copy, then the body 101 may be carbon paper.

The first detachable stub 104 and the second detachable stub 105 may be portions of the page 111 that are detachable from the body 101. The first detachable stub 104 and the second detachable stub 105 may be attached to the body 101 by the first detachment line 106 and the second detachment line 107. The first detachable stub 104 and the second detachable stub 105 may be attached on opposite edges of the body 101. For example, if the first detachable stub 104 is attached to the top of the body 101, the second detachable stub 105 may be attached to the bottom of the body 101.

The first detachment line 106 and the second detachment line 107 may be lines spanning the width of the page 111 along which the material has been weakened, for example, through perforation or shallow cutting. The material of the page 111 may be weakened enough that a person may detach the body 101 from the first detachable stub 104 and the second detachable stub 105 with little resistance by tearing the page 111 along the first detachment line 106 and the second detachment line 107. Such a tear may occur straight along the first detachment line 106 and the second detachment line 107, creating a clean separation between the body 101 and the first detachable stub 104 and the second detachable stub 105. This may prevent jagged tears that may result from tearing material that has not been weakened, preserving the body 101 of the page 111 of the form 112 for future uses.

The first adhesive label 201 and the second adhesive label 202 may be adhesive labels that may be used to attach the form assembly 113 to a surface. As depicted in FIG. 2, the first adhesive label 201 may include a liner 102 and an adhesive layer 109, and the second adhesive label 202 may include a liner 103 and an adhesive layer 110.

The adhesive layers 109 and 110 may be made of a lite-tac adhesive applied to a non-adhesive backing. The lite-tac adhesive may be an adhesive that may attach securely to a surface while being easily removable with the application of force that pulls the adhesive directly away from the surface, i.e. a force operating perpendicular to the surface. The lite-tac adhesive may be removed from the surface by hand, requiring no special tools, soaps, chemicals or water. Attempting to remove the lite-tac adhesive from a surface with force in a different direction may require a greater amount of force, such that anything attached to a surface with a lite-tac adhesive is not susceptible to accidental removal. The lite-tac adhesive may leave behind little or no adhesive residue on a surface after being removed. For example, a Post-It note by 3M employs a lite-tac adhesive to allow small pieces of paper to be attached to surfaces, where they remain secured until pulled straight off of the surface. After the Post-It note is removed from the surface, the lite-tac adhesive leaves behind no residue. The lite-tac adhesive used in the adhesive layers 109 and 110 may be lite-tac adhesive formulated to be difficult to remove from attached paper products, but easy to remove from harder surfaces such as, for example, glass.

The liners 102 and 103 may be made from any suitable material for removably attaching to the lite-tac adhesive of the adhesive layers 109 and 110. The liners 102 and 103 may be used to protect the lite-tac adhesive of the adhesive layers 109 and 110 from environmental conditions that may adversely affect the adhesive's adherent properties, and to prevent the adhesive layers 109 and 110 from accidentally sticking to anything. Before the lite-tac adhesive is used to attach the first adhesive label 201 and the second adhesive label 202 to the form 112 to create the form assembly 113, and before the form assembly 113 is attached to a surface, the lite-tac may need to be protected so that, for example, dust, does not gather on the lite-tac adhesive. The liners 102 and 103 may attach to the lite-tac adhesive, preventing it from being exposed until the liners 102 and 103, or portions thereof, are removed. FIGS. 3*a*-3*e* depict exemplary front and side views of an adhesive label in different states during the assembly and use of the form assembly 113.

Figure 3A:
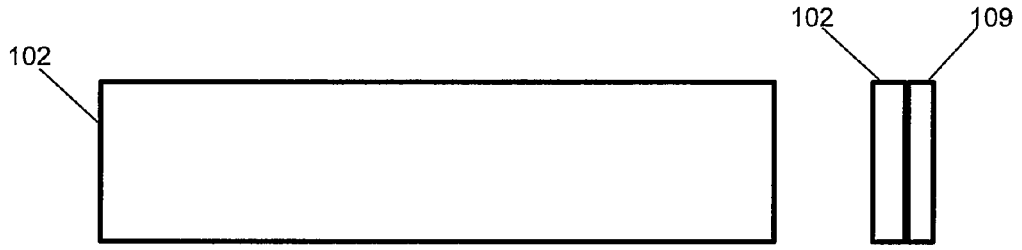
FIGS. 3*a*-3*e* depict front and side views of adhesive label in different states during the assembly and use of the form assembly.

In FIG. 3*a*, the front angle view shows only the liner 102. The side angle view shows the liner 102 attached to the lite-tac adhesive of the adhesive layer 109. The liner 102 may cover the entirety of the lite-tac adhesive of the adhesive layer 109.

Figure 3B:
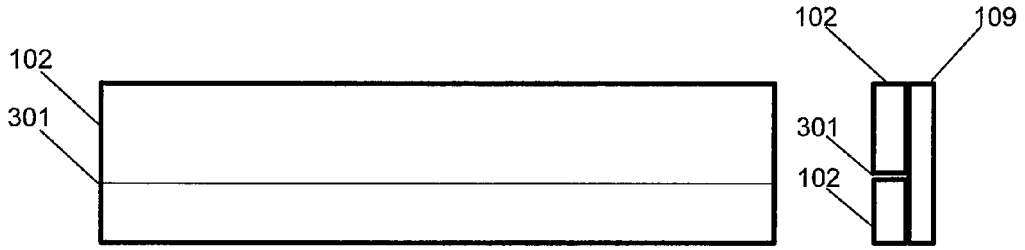

In FIG. 3*b*, the liner 102 may be kisscut with kisscut 301. A kisscut may be a cut made in a material with two or more layers that does not penetrate all of the layers. The front angle view shows the kisscut 301 extending the length of the adhesive label 102. The side angle view shows how the kisscut 301 may divide the liner 102 into two separate pieces while leaving the adhesive layer 109 intact.

Figure 3C:
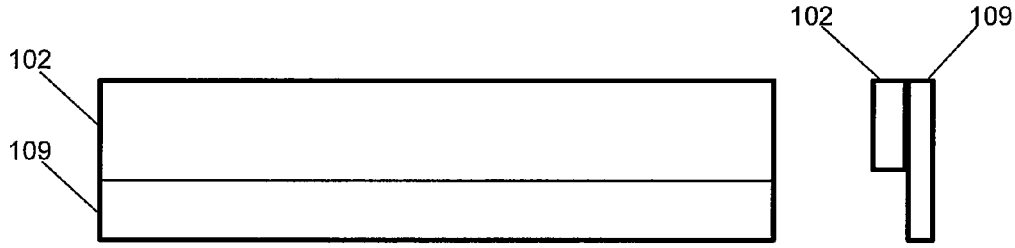

In FIG. 3*c*, a portion of the liner 102 below the kisscut 301 may be removed from the adhesive layer 109. The lite-tac adhesive of the adhesive layer 109 may be partially exposed, with the unexposed portion still covered by the liner 102. In this state, the first adhesive label 201 may be attached to either the first detachable stub 104 or the second detachable stub 105, as further described in FIG. 4 and FIG. 7.

Figure 3D:
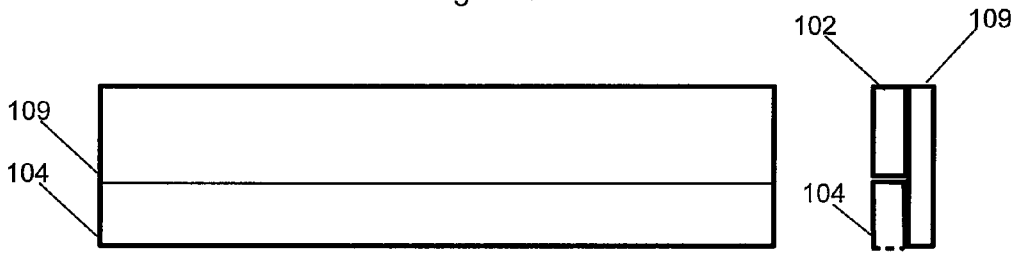

In FIG. 3*d*, the first adhesive label 201 may be attached to the first detachable stub 104. The previously exposed lite-tac adhesive of the adhesive layer 109 may be used to attach the first adhesive label 201 to the first detachable stub 104, which may be attached to the body 101. This portion of the lite-tac adhesive may no longer be exposed. The remainder of the lite-tac adhesive of the adhesive layer 109 may still be covered by the liner 102. The adhesive label 201 may be attached to the first detachable stub 104 such that the first adhesive label 201 does not overlap the first detachment line 106. This may be the state in which the form assembly 113 may be distributed to users of the form assembly 113.

Figure 3E:
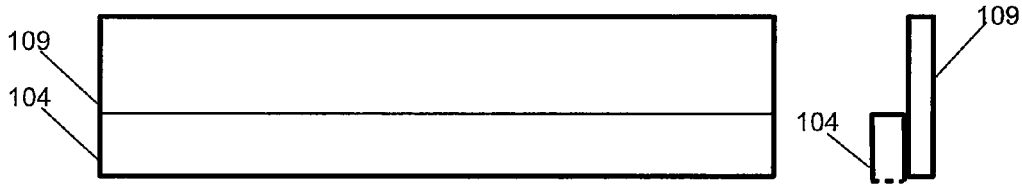

In FIG. 3*e*, the first adhesive label 201 may be attached to the first detachable stub 104, and the rest of the liner 109 may be removed. The removal of the rest of the liner 109 may expose the lite-tac adhesive on the portion of the adhesive layer 109 that is not attached to the first detachable stub 104. This may be the state in which the first adhesive label 201 may be used to attach the form assembly 113 to a surface.

Figure 4:
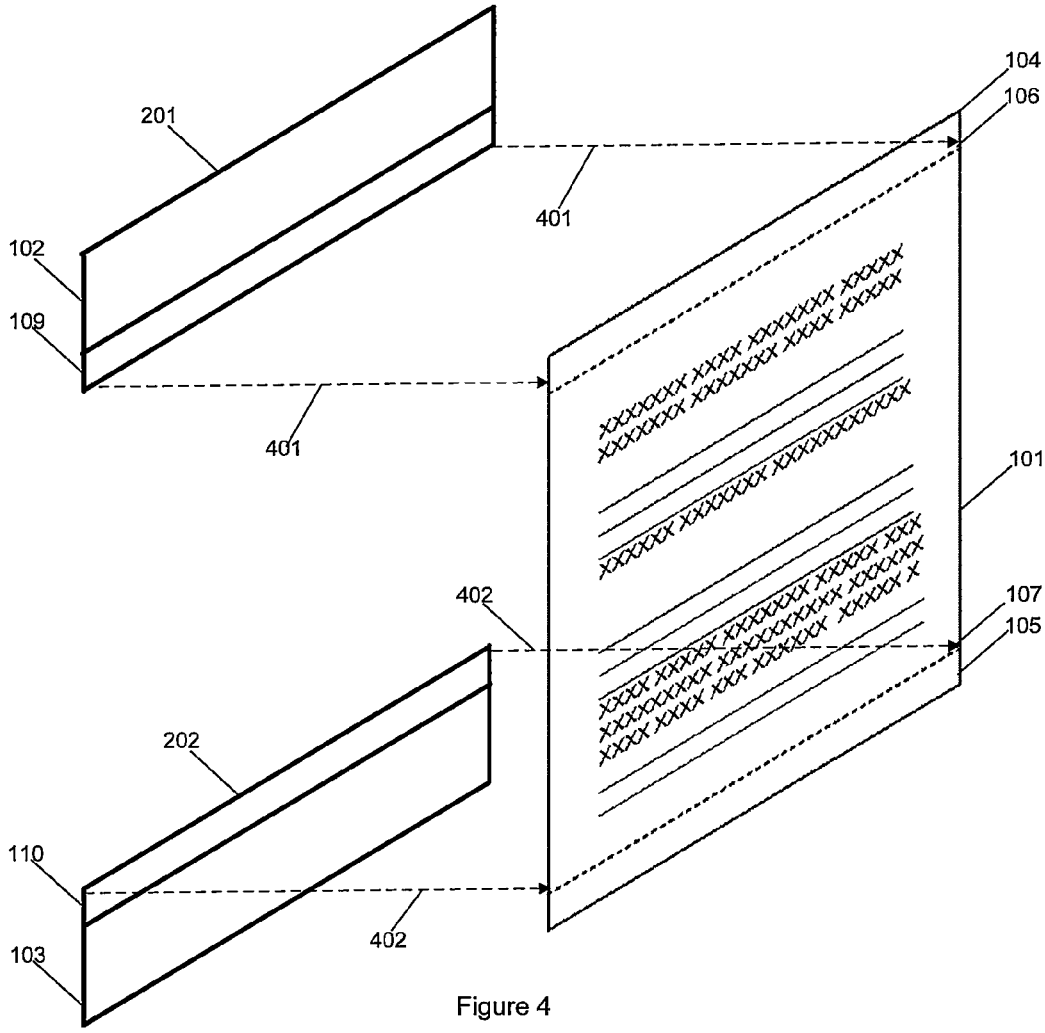
FIG. 4 depicts an angled view of an exemplary form assembly prior to being assembled.
Figures 7A, 7B, 7C, 7D:
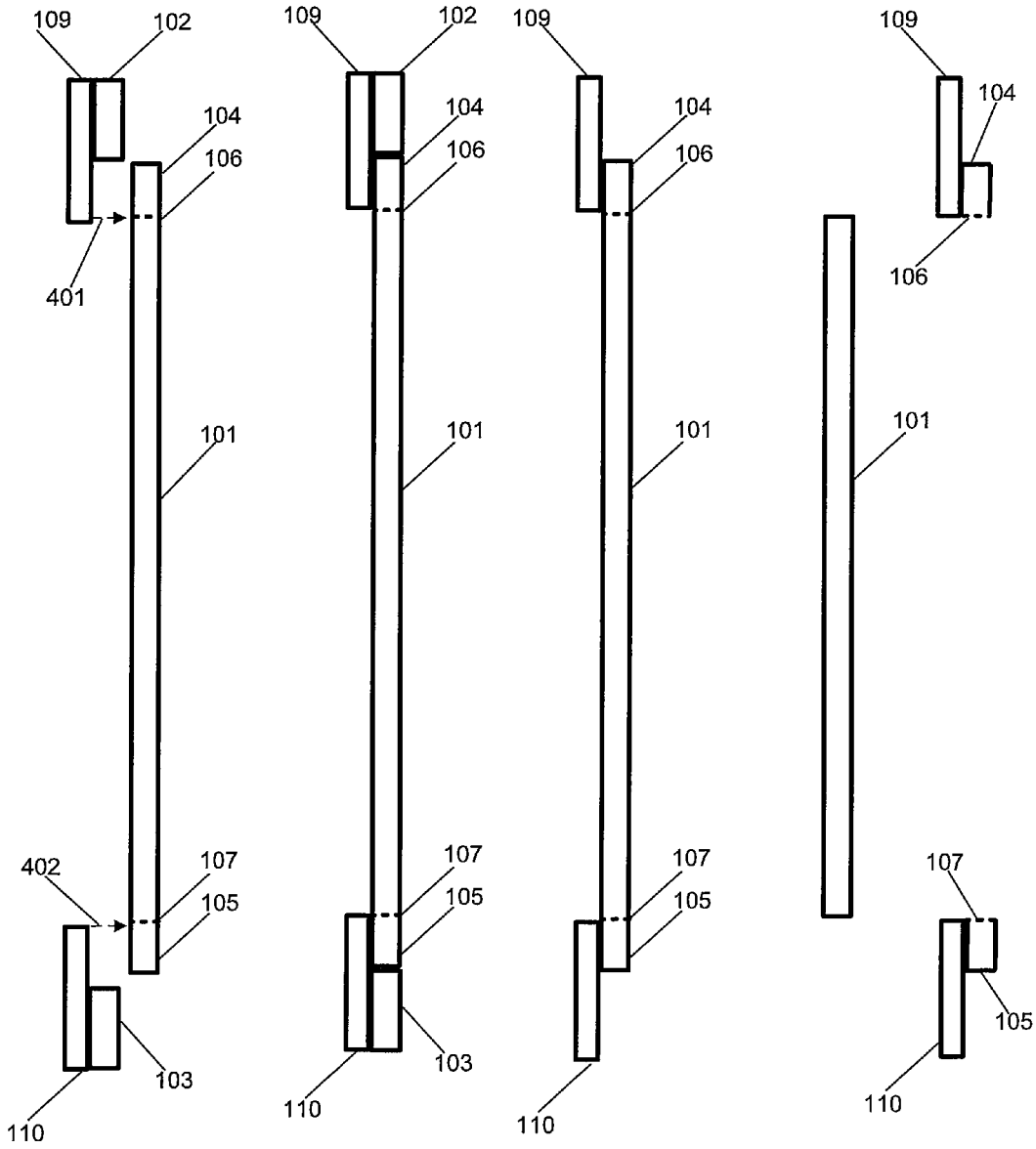
FIGS. 7*a*-7*d* depict a side view of an exemplary form assembly with a one-page form in different states during the assembly and use of the form assembly.

FIG. 4 depicts an angled view of an exemplary form assembly prior to being assembled. FIG. 7*a* depicts a side view of an exemplary form assembly in a state corresponding to FIG. 4. The first adhesive label 201 and the second adhesive label 202 may be in the state depicted and discussed above in FIG. 3*c*.

The exposed lite-tac adhesive of the adhesive layer 109 of the first adhesive label 201 may be aligned with the first detachable stub 104. Dashed lines 401 may demonstrate the alignment between the first adhesive label 201 and the first detachable stub 104. The exposed lite-tac adhesive of the adhesive layer 110 of the second adhesive label 202 may be aligned with the second detachable stub 105. Dashed lines 402 may demonstrate the alignment between the second adhesive label 202 and the second detachable stub 105.

FIG. 7*b* depicts a side view of an exemplary form assembly after the form assembly 113 is assembled. The first adhesive label 201 and the second adhesive label 202 may be in the state depicted and discussed above in FIG. 3*d*. The first adhesive label 201 may be attached to the first detachable stub 104 using the exposed lite-tac adhesive of the adhesive layer 109. The attachment between the first adhesive label 201 and the first detachable stub 104 may follow the alignment of dashed lines 401, such that the exposed lite-tac adhesive of the adhesive layer 109 adheres to the first detachable stub 104 but does not overlap the first detachment line 106. The second adhesive label 202 may be attached to the second detachable stub 105 using the exposed lite-tac adhesive of the adhesive layer 110. The attachment between the second adhesive label 202 and the second detachable stub 105 may follow the alignment of dashed lines 402, such that the exposed lite-tac adhesive of the adhesive layer 110 adheres to the second detachable stub 105 but does not overlap the second detachment line 107.

Figure 5:
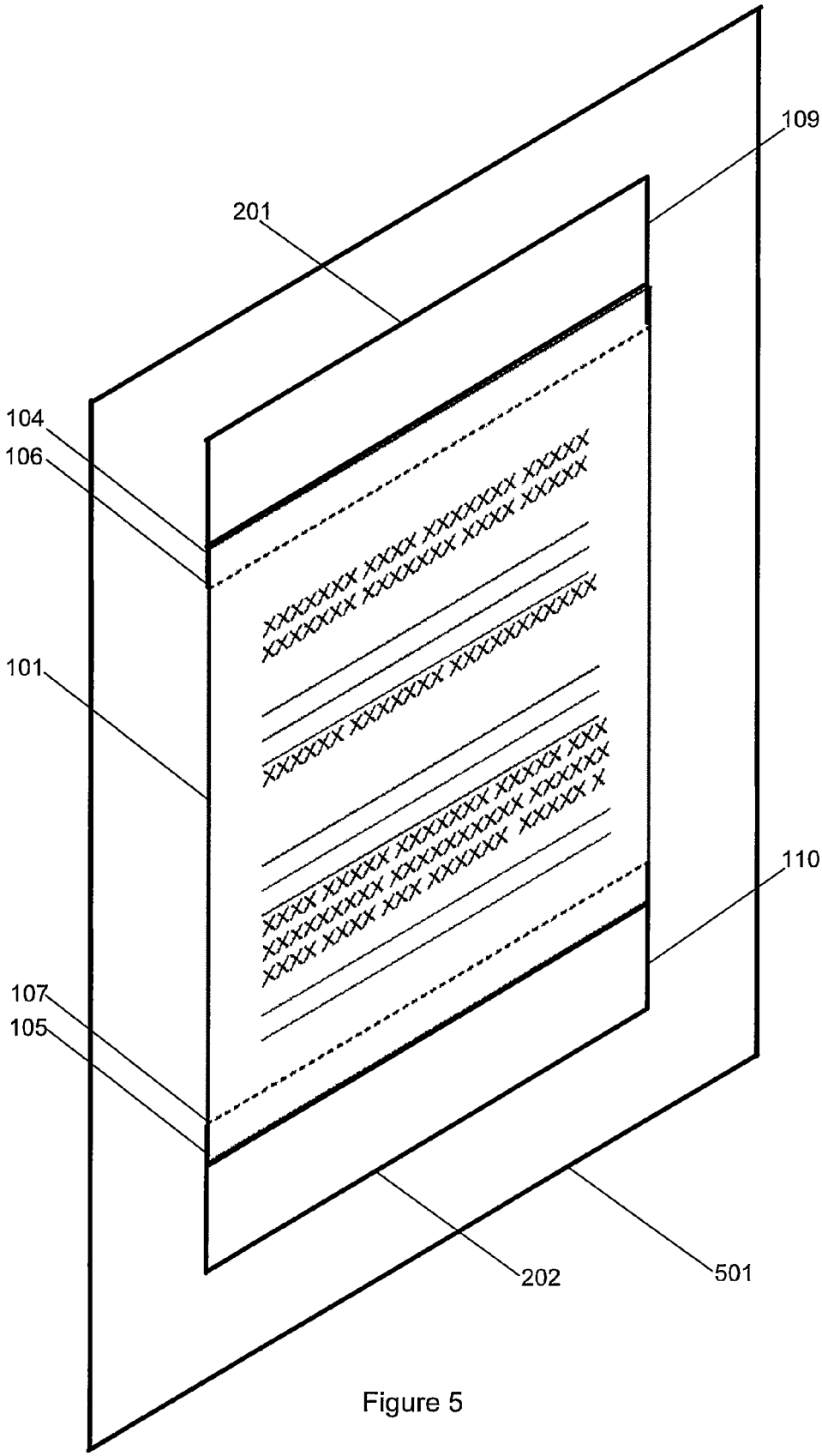
FIG. 5 depicts an angled view of an exemplary form assembly attached to an exemplary transparent surface as viewed through the surface.

FIG. 5 depicts an angled view of an exemplary form assembly attached to an exemplary transparent surface as viewed through the surface. FIG. 7*c* depicts a side view of an exemplary form assembly in a state corresponding to FIG. 5. The first adhesive label 201 and the second adhesive label 202 may be in the state depicted and discussed above in FIG. 3*e*. The liners 102 and 103 may be removed from the first adhesive label 201 and the second adhesive label 202. This may expose the portion of the lite-tac adhesive of the adhesive layers 109 and 110 not already used to attach the adhesive labels 201 and 202 to the first detachable stub 104 and the second detachable stub 105.

The exposed portion of the lite-tac adhesive may be used to attach form assembly 113 to a surface 501. The exemplary surface 501 depicted in FIG. 5 may be a glass surface, for example, the door window of a car. FIG. 5 depicts the form assembly 113 as viewed from the exterior of the car, through the door window. The form assembly 113 depicted in FIG. 5 may have information contained in the body 101 of the front page 111 of the form 112 on the same side of the page 111 as the lite-tac adhesive of the adhesive layers 109 and 110. If the exemplary form assembly 113 is attached to the inside of the exemplary glass door window surface 501, the information on the body 101 may be visible from outside of the car, through the window. In other exemplary embodiments, information may be contained on one or both sides of any page 111 in the form 112, so that, for example, information may be visible on the body 101 if the form assembly 113 is attached to an opaque surface.

Figure 6:
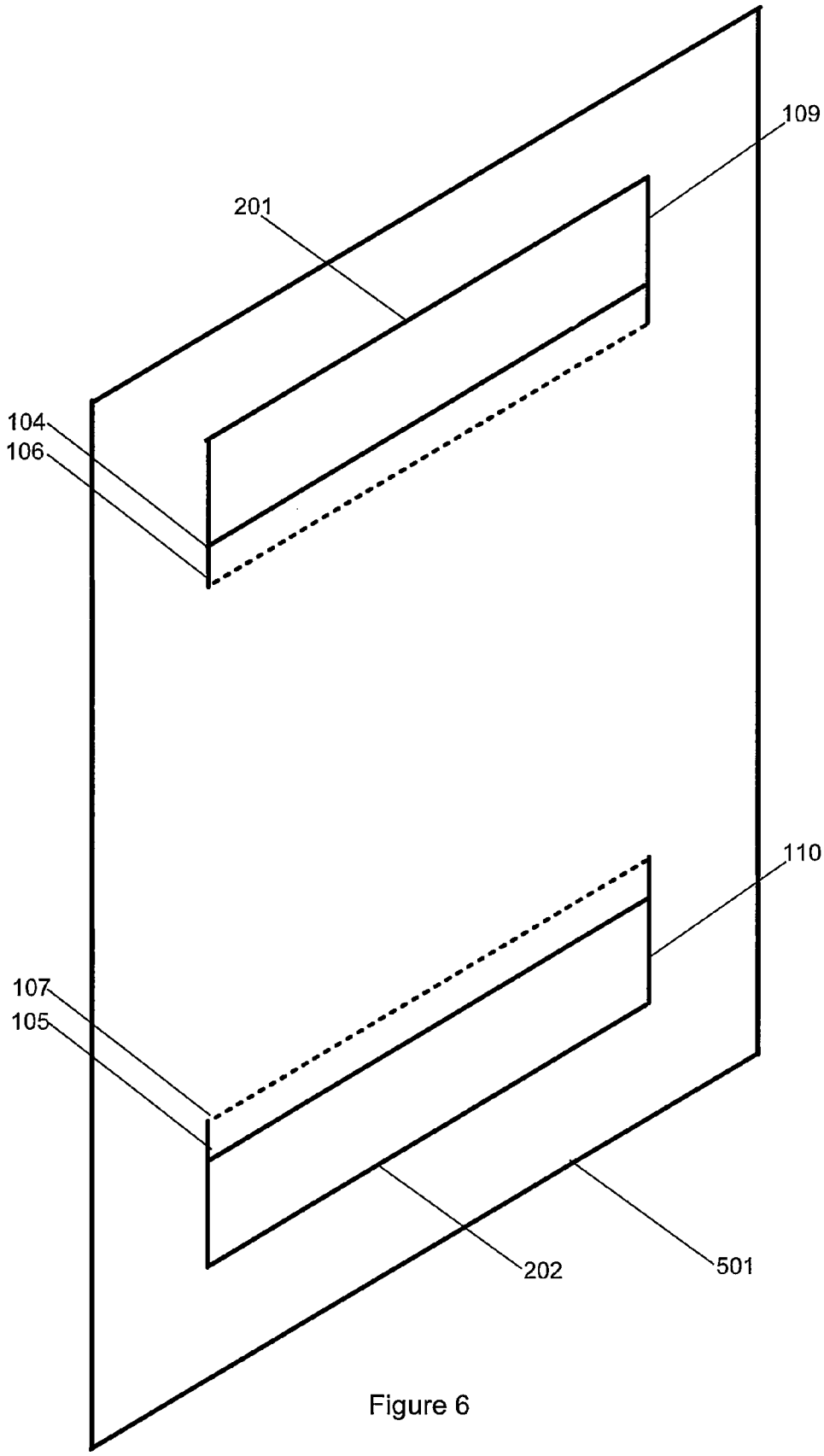
FIG. 6 depicts an angled view of an exemplary form assembly attached to an exemplary transparent surface after the body of the page of the form has been detached from the exemplary form assembly.

FIG. 6 depicts an angled view of an exemplary form assembly attached to an exemplary transparent surface after the body of the page of the form has been detached from the exemplary form assembly. FIG. 7*d* depicts a side view of an exemplary form assembly in a state corresponding to FIG. 6. The body 101 of the single page 111 of the exemplary form 112 may be removed from the form assembly 113 after the form assembly 113 has been attached to the surface 501. The body 101 may be removed from the form assembly 113 by detaching the body 101 from the first detachable stub 104 along the first detachment line 106, and from the second detachable stub 105 along the second detachment line 107.

For example, if the first detachment line 106 and the second detachment line 107 are perforated lines, the body 101 may be removed pulling one edge of the body 101 parallel to the detachment lines 106 and 107, tearing the perforations. Because the lite-tac adhesive of the first adhesive label 201 and the second adhesive label 202 may not overlap the first detachment line 106 and 107, the body 101 may not be attached to any lite-tac adhesive, allowing for the body 101 to be removed more easily, without removing the first adhesive label 201 and the second adhesive label 202 from the surface 501.

Once the body 101 has been removed from the form assembly 113, it may be used for any suitable purpose. For example, the form assembly 113 may be attached to the inside of a car window, which may include special features such as window de-fogging elements that are sensitive to aggressive adhesives and harsh cleaning methods. The form 112 may be a government-mandated Buyers Guide for the car, with the pertinent information contained on the body 101 of a single page 111 of the form 112. When a prospective customer is attempting to complete the purchase of the car, the body 101 may be removed from the form assembly 113, allowing the Buyers Guides to be used to complete the purchase of the car.

After the body 101 has been removed from the form assembly 113, the first detachable stub 104 and the second detachable stub 105 may remain attached to the lite-tac adhesive of the adhesive layers 109 and 110 of the first adhesive label 201 and the second adhesive label 202. The first adhesive label 201 and the second adhesive label 202 may remain attached to the surface 501. The first adhesive label 201 and the second adhesive label 202 may be removed from the surface 501 at a later time. The lite-tac adhesive used to attach the first adhesive label 201 and the second adhesive label 202 to the surface may allow removal of the first adhesive label 201 and the second adhesive label 202 without the need for special tools, soaps, chemicals, or water. Further, the surface will not be marred or damaged in the process. For example, the first adhesive label 201 and the second adhesive label 202 may be removed from the surface 501 by hand, by pulling the first adhesive label 201 and the second adhesive label 202 off of the surface 501. The lite-tac adhesive may leave behind little or no adhesive residue once the first adhesive label 201 and the second adhesive label 202 have been removed from the surface 501.

In an alternative embodiment, the form 112 may have more than one page 111. FIGS. 8*a*-8*d* depict side views of an exemplary form assembly with a two-page form in different states during the assembly and use of the exemplary form assembly.

Figures 8A, 8B, 8C, 8D:
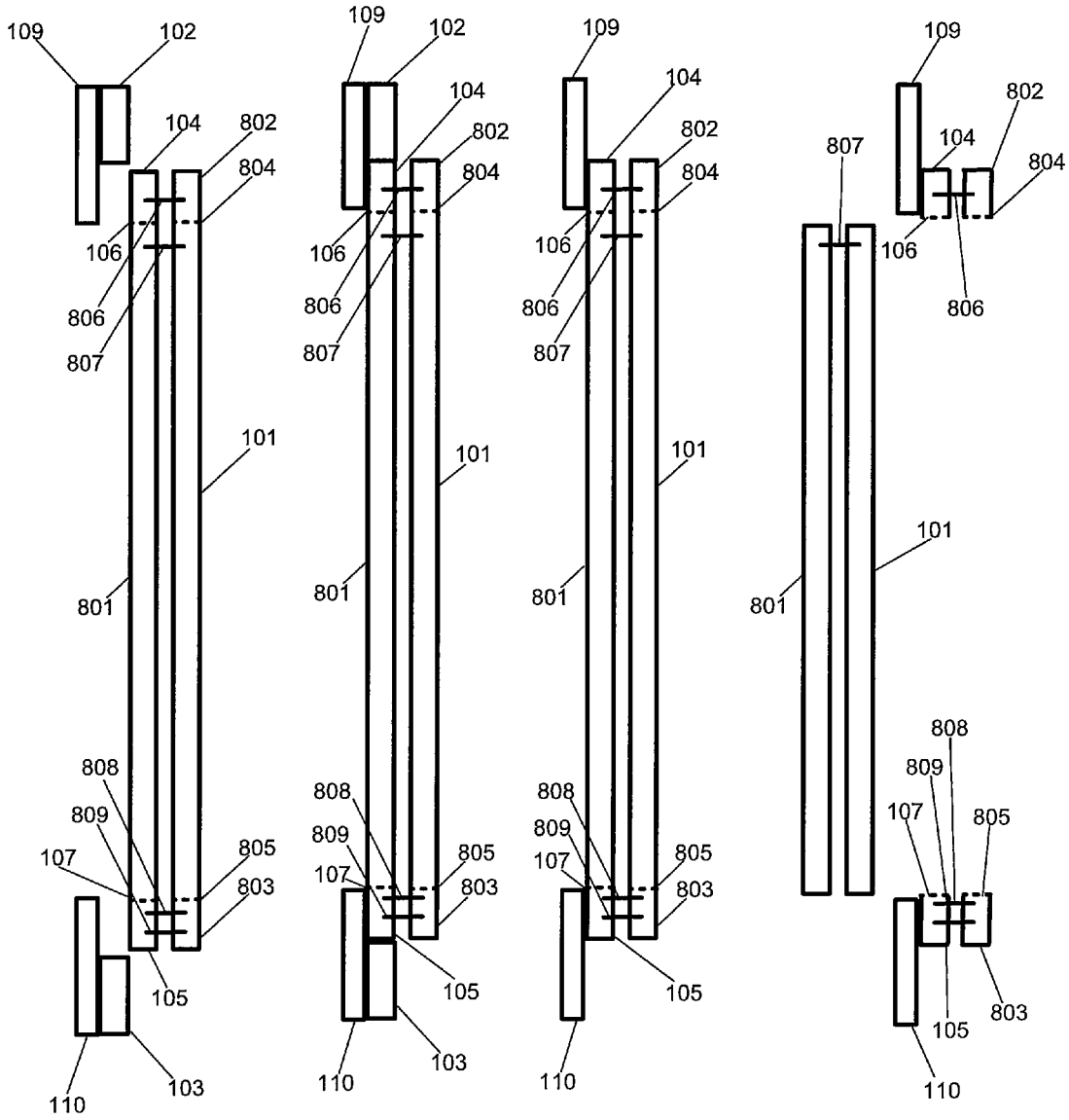
FIGS. 8*a*-8*d* depict side views of an exemplary form assembly with a two-page form in different states during the assembly and use of the form assembly.
Figures 9A, 9B, 9C, 9D:
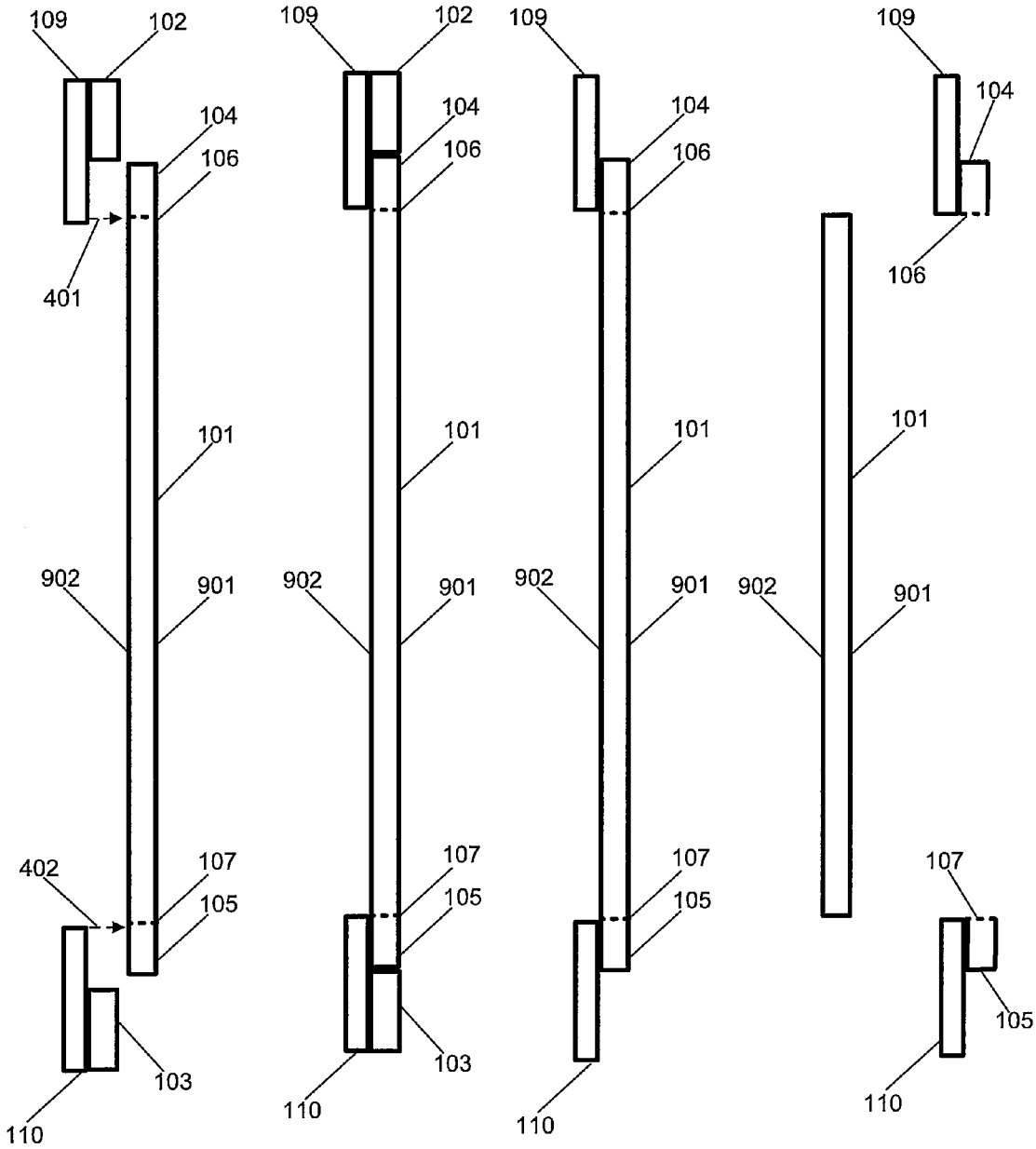
FIGS. 9*a*-9*d* depict a side view of an exemplary form assembly with a one-page form where the page has a front side and back side in different states during the assembly and use of the form assembly.

FIG. 8*a* depicts a side view of the exemplary form 112, which has two pages 111. The second page 111 may have a body 801, a first detachable stub 802 attached to the body 801 by a first detachment line 804, and a second detachable stub 803 attached to the body 801 by a second detachment line 805. The two pages 111 of the form 112 may be attached to one another through the use of adhesive glue placement applied to the pages 111. The adhesive glue placement may be, for example, a line of glue. Glue lines 806, 807, 808, and 809 may be lines of adhesive glue applied to one of the pages 111 to which the other page 111 is then attached, holding the pages 111 together. As depicted in FIG. 8*a*, the glue line 806 may be applied to the first detachable stub 104, which may then be attached to the first detachable stub 802. The glue line 807 may be applied just below the first detachment line 106 on the body 101, which may then be attached to the body 801 just below the first detachment line 804. The glue lines 808 and 809 may both be applied to the second detachable stub 105, which may then be attached to the second detachable stub 803.

FIG. 8*b* depicts a side view of the first adhesive label 201 and the second adhesive label 202 attached to the exemplary form 112 to form the exemplary form assembly 113, similarly to FIGS. 5 and 7*a*. The first adhesive label 201 and the second adhesive label 202 may be attached to the first detachable stub 104 and the second detachable stub 105, respectively, as depicted in FIG. 8*b*. When the form 112 has more than one page 111, the first adhesive label 201 and the second adhesive label 202 may be attached to either the front or back page 111, depending on the manner in which information is contained on the pages 111 and the intended use of the form assembly 113.

FIG. 8*c* depicts a side view of the exemplary form assembly 113 with the two-page form 112 attached to a surface, for example, the surface 501 depicted in FIG. 5. The form assembly 113 with the two-page form 112 may be attached to the surface 501 in the same manner as the one-page form 112 depicted in FIG. 5 and FIG. 7*c*.

FIG. 8*c* depicts a side view of the exemplary form assembly 113 with the body 101 and the body 802 detached from the form assembly 113. The body 101 and the body 801 of the pages 111 of the exemplary form 112 may be removed from the form assembly 113 after the form assembly 113 has been attached to the surface 501. The body 101 and the body 801 may be removed from the form assembly 113 by detaching the body 101 and the body 801 from the first detachable stub 104 and the first detachable stub 802 along the first detachment line 106 and the first detachment line 804, and from the second detachable stub 105 and the second detachable stub 803 along the second detachment line 107 and the second detachment line 805. Because of the placement of the glue lines 806, 807, 808 and 809, relative to the first detachment lines 106 and 804 and the second detachment lines 107 and 805, the bodies 101 and 801 of the pages 111 may remain attached to each other by glue line 807 on the end that was near the first detachable stubs 104 and 802. The bodies 101 and 801 may be detached from each other at the end that was near the second detachable stubs 105 and 803, as the glue lines 808 and 809 were not on the bodies 101 and 801, and may remain as the attachment between the second detachable stubs 105 and 803 after the bodies 101 and 801 are detached. This may allow the pages 111 to be used after detachment as a two-page form joined at the top.

In alternative embodiments, there may be any number of pages 111 in the form 112, and the pages 111 may be placed in any suitable order and joined together in any suitable manner, based on the purpose of the form 112 and the form assembly 113.

In another alternative embodiment, the page 111 may have a front side and a back side. FIGS. 9*a*-9*d* depict side views of an exemplary form assembly with a one-page form where the page has a front side and back side in different states during the assembly and use of the form assembly. FIGS. 9*a*-9*d* may correspond to FIGS. 7*a*-7*d* in depicted the states of the form assembly 113 during the assembly and use of the form assembly 113. The page 111, including the body 101, the first detachable stub 104 and the second detachable stub 105, may have a front side 901, and a back side 902. The first adhesive label 201, including the liner 102 and the adhesive layer 109, and the second adhesive label 202, including the liner 103 and the adhesive layer 110, may be attached to the back side 902 of the page 111. The front side 901 of the page 111 may contain information that needs to be visible if the form assembly 113 is attached to a transparent surface, such as, for example, a car window. If additional pages 111 are added to the form 112, the additional pages 111 may be attached to the front side 901 of a page 111 that is closest to the page 111 attached to the first adhesive label 201 and the second adhesive label 202 that does not already have a page 111 attached to the front side 901.

Figure 10A:
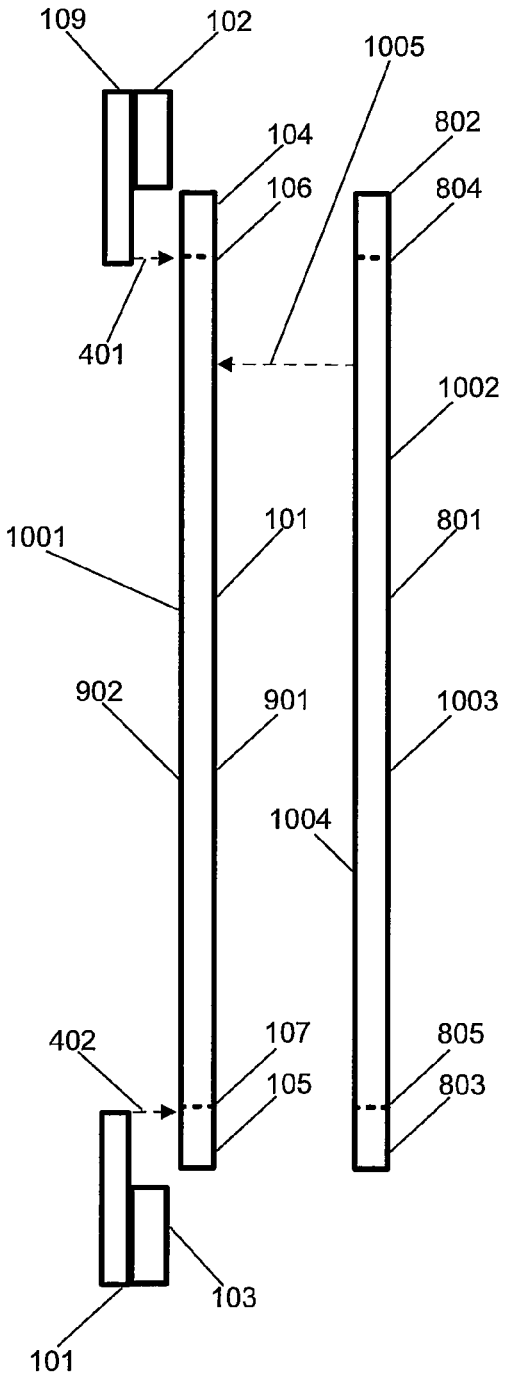
FIGS. 10*a*-10*b* depict side views of an exemplary form assembly being assembled with multiple pages.
Figure 10B:
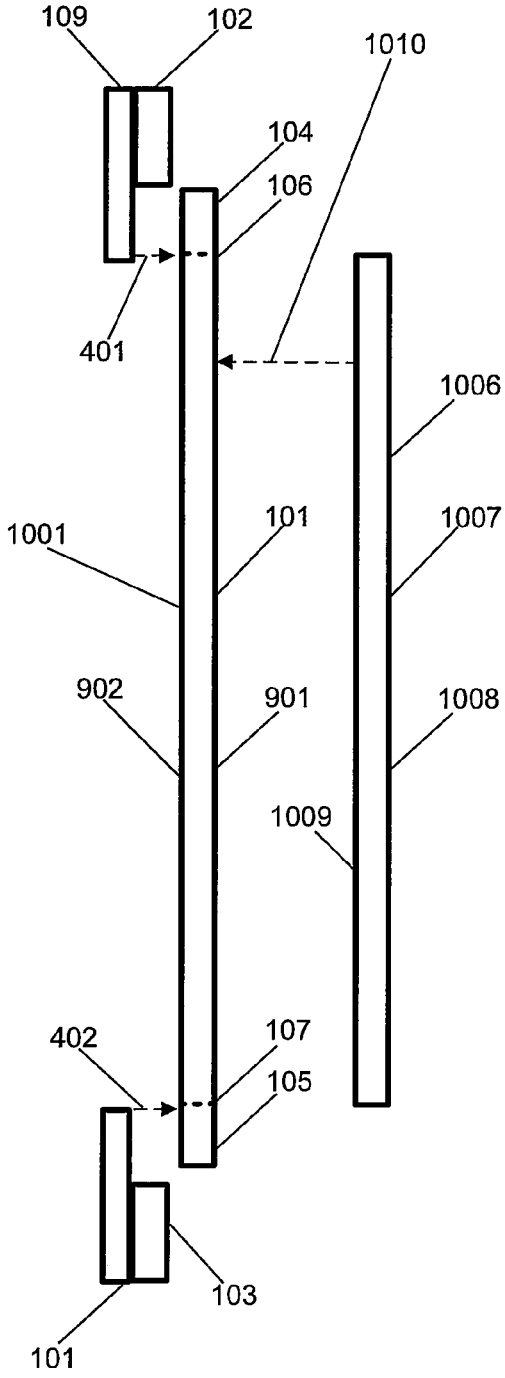

FIGS. 10*a*-10*b* depict side views of an exemplary form assembly being assembled with multiple pages. FIG. 10*a* depicts a side view of an exemplary form assembly with a second page that includes a first detachable stub and a second detachable stub. The form assembly may have two pages 111, exemplary first page 1001 and exemplary second page 1002. The exemplary first page 1001 may have the front side 901 and the back side 902. The first adhesive label 201 and the second adhesive label 202 may be attached to the back side 902 of the exemplary first page 1001. This may create an "envelope effect", such that when the form assembly 113 is attached to a surface, the first adhesive label 201, the second adhesive label 202, and the first page 1001 act as an envelope protecting any additional page 111 added to the form 112. For example, if the form assembly 113 is attached to a car door window, the envelope created by the first adhesive label 201, the second adhesive label 202, and the first page 1001 may protect any additional page 111 from being damaged by the rolling up and down of the window.

In FIG. 10*a*, the additional page 111 may be the exemplary second page 1002. The exemplary second page 1002 may have a front side 1003 and a back side 1004. The exemplary second page 1002 may be attached to the form assembly 113 by attaching the back side 1004 of the exemplary second page 1003 to the front side 901 of the exemplary first page 1001, as shown by an alignment line 1005. If a third page 111 is added to the form assembly 113, the back side of the third page 111 may be attached to the front side 1003 of the exemplary second page 1002, as the front side 901 of the exemplary first page 1001 may already be covered by the exemplary second page 1002. In this manner, any number of pages 111 may be added to the form assembly 113.

The body 101 may include a third detachable stub 1101. The third detachable stub 1101 may be a portion of the page 111 that may be detachable from the body 101. The third detachable stub 110 may be attached to the body 101 by a third detachment line 1102. The third detachable stub 1101 may be attached to the body 101 on a different edge of the body than the first detachable stub 104 and the second detachable stub 105. For example, if the first detachable stub 104 is attached to the top of the body 101 and the second detachable stub 105 is attached to the bottom of the body 101, the third detachable stub 1101 may be attached to the side of the body 101.

The third detachment line 1102 may be a line spanning the width or length of the page 111 along which the material has been weakened, for example, through perforation or shallow cutting. The material of the page 111 may be weakened enough that a person may detach the body 101 from the first detachable stub 104, the second detachable stub 105, and the third detachable stub 1101 with little resistance by tearing the page 111 along the first detachment line 106, the second detachment line 107, and the third detachment 1102. Such a tear may occur straight along the first detachment line 106, the second detachment line 107, and the third detachment line 1102, creating a clean separation between the body 101 and the first detachable stub 104, the second detachable stub 105, and the third detachable stub 1101. This may prevent jagged tears that may result from tearing material that has not been weakened, preserving the body 101 of the page 111 of the form 112 for future uses.

Figure 11:
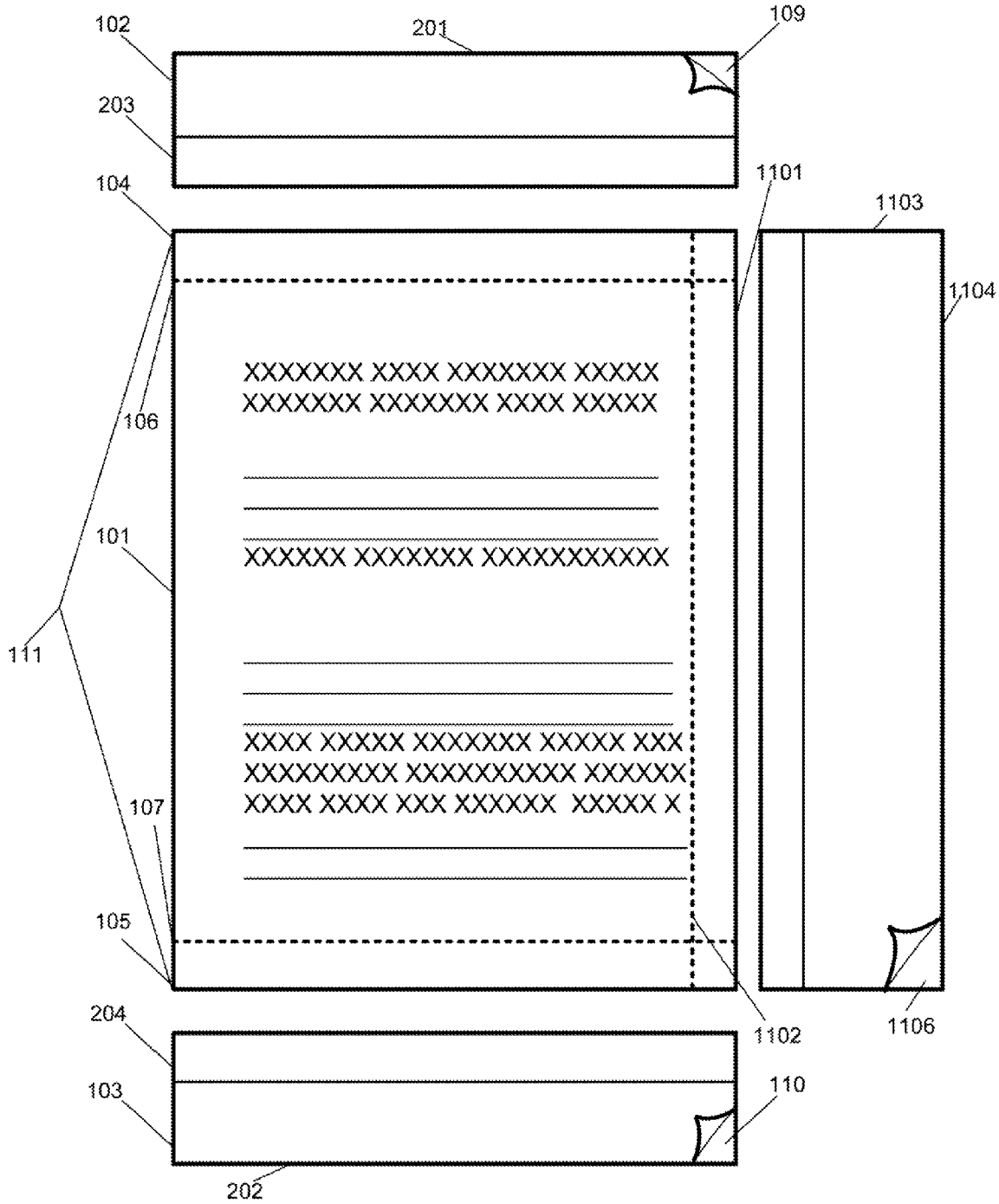
FIG. 11 depicts one embodiment of an exemplary form assembly with a third detachable stub before being assembled.

The third adhesive label 1104 may be an adhesive label that may be used to attach the form assembly 113 to a surface. As depicted in FIG. 11, the third adhesive label 1104 may include a liner 1103 and an adhesive layer 1106. The adhesive layer 1106 may be made of a lite-tac adhesive applied to a non-adhesive backing, similar to the adhesive layers 109 and 110.

The liners 1103 may be made from any suitable material for removably attaching to the lite-tac adhesive of the adhesive layer 1106. The liners 1103 may be used to protect the lite-tac adhesive of the adhesive layer 1106 from environmental conditions that may adversely affect the adhesive's adherent properties, and to prevent the adhesive layer 1106 from accidentally sticking to anything. Before the lite-tac adhesive is used to attach the third adhesive label 1101 to the form 112, and before the form assembly 113 is attached to a surface, the lite-tac may need to be protected so that, for example, dust, does not gather on the lite-tac adhesive. The liner 1103 may attach to the lite-tac adhesive, preventing it from being exposed until the liner 1103, or a portion thereof, is removed.

FIG. 10*b* depicts a side view of an exemplary form assembly with a second page that does not include a first detachable stub and a second detachable stub. The additional page 111 in FIG. 10*b* may be exemplary second page 1006. The exemplary second page 1006 may include a body 1007, a front side 1008, and a back side 1009. The exemplary second page may no first or second detachable stub, and may be attached to the exemplary first page 1001 by attaching the back side 1009 of the exemplary second page 1006 to the front side 901 of the exemplary first page 1001, as shown by alignment line 1010. Any pages added to the form assembly 113 after the first page 1001 may have any number of detachment stubs, including none, as the first detachable stub 104 and the second detachable stub 105 may only be necessary on the first page 1001, to attach the first adhesive label 201 and the second adhesive label 202.

It is to be understood that the figures and descriptions of the embodiments have been simplified to illustrate elements that are relevant for a clear understanding of the present embodiments, while eliminating, for purposes of clarity, other elements. Those of ordinary skill in the art will recognize, however, that these and other elements may be desirable. However, because such elements are well known in the art, and because they do not facilitate a better understanding of the present embodiments, a discussion of such elements is not provided herein. It should be appreciated that the figures are presented for illustrative purposes and not as construction drawings. Omitted details and modifications or alternative embodiments are within the purview of persons of ordinary skill in the art.

It can be appreciated that, in certain aspects of the present embodiments, a single component may be replaced by multiple components, and multiple components may be replaced by a single component, to provide an element or structure or to perform a given function or functions. Except where such substitution would not be operative to practice certain embodiments of the present embodiments such substitution is considered within the scope of the present embodiments.

The examples presented herein are intended to illustrate potential and specific implementations of the present embodiments. It can be appreciated that the examples are intended primarily for purposes of illustration of the embodiments for those skilled in the art. The diagrams depicted herein are provided by way of example. There may be variations to these diagrams or the operations described herein without departing from the spirit of the embodiments. For instance, in certain cases, method steps or operations may be performed or executed in differing order, or operations may be added, deleted or modified.

Furthermore, whereas particular embodiments have been described herein for the purpose of illustrating the embodiments the and not for the purpose of limiting the same, it will be appreciated by those of ordinary skill in the art that numerous variations of the details, materials and arrangement of elements, steps, structures, and/or parts may be made within the principle and scope of the embodiments without departing from the embodiments as described in the following claims.

What is claimed is:

1. A form assembly for removably attaching a form to a surface comprising:

the form comprising a page, the page comprising:

a body, a first detachable stub attached to a first edge of the body by a first detachment line, a second detachable stub attached to a second edge of the body opposite the first edge by a second detachment line;

a first adhesive label comprising a lite-tac adhesive, wherein the first adhesive label and the lite-tac adhesive are aligned with the first detachment line such that the aligned portion of the first adhesive label is attached to the first detachable stub by the aligned portion of the lite-tac adhesive, wherein the lite-tac adhesive does not overlap the first detachment line;

a second adhesive label comprising a lite-tac adhesive, wherein the second adhesive label and the lite-tac adhesive are aligned with the second detachment line such that the aligned portion of the second adhesive label is attached to the second detachable stub by the aligned portion of the lite-tac adhesive, wherein the lite-tac adhesive does not overlap the second detachment line;

wherein the lite-tac adhesive of the first adhesive label and the lite-tac adhesive of the second adhesive label are adapted to removably secure the form assembly to a surface, and to leave little adhesive residue on the surface when the form assembly is removed; and a second page comprising a body, wherein the second page is attached to the page by a first adhesive glue placement attaching the body of the page to the body of the second page, and wherein an entirety of the first adhesive glue placement is disposed just below the first detachment line and between the first detachment line and the second detachment line.

2. The assembly of claim 1, wherein the second page further comprises:

a first detachable stub attached to a first edge of the body by a first detachment line, a second detachable stub attached to a second edge of the body opposite the first edge by a second detachment line; and wherein the second page is attached to the page by a second adhesive glue placement attaching the first detachable stub of the page to the first detachable stub of the second page and a third adhesive glue placement attaching the second detachable stub of the page to the second detachable stub of the second page.

3. The assembly of claim 1, wherein the first edge is a top edge of the body, and the second edge is a bottom edge of the body.

4. The assembly of claim 1, wherein the first edge is a left edge of the body, and the second edge is a right edge of the body.

5. The assembly of claim 1, wherein the page further comprises a third detachable stub attached to a third edge of the body by a third detachment line, and wherein the form assembly further comprises a third adhesive label comprising a lite-tac adhesive side, the third adhesive label attached to the third detachable stub by the lite-tac adhesive side, wherein the lite-tac adhesive does not overlap the third detachment line.

6. The assembly of claim 1, wherein the body of the page is wholly detachable from the first detachable stub and the second detachable stub after the form assembly is attached to the surface, and wherein the body of the page and the body of the second page remain attached by the first adhesive glue placement when the body of the page is wholly detached from the first detachable stub and the second detachable stub.

7. The assembly of claim 6, wherein wholly detaching the body from the first detachable stub and the second detachable stub after the form assembly is attached to the surface results in the first detachable stub, the first adhesive label, the second detachable stub, and the second adhesive label remaining attached to the surface.

8. The assembly of claim 1, wherein the page further comprises:

a front side, and a back side, wherein the first adhesive label is attached to the first detachable stub on the back side of the page, and wherein the second adhesive label is attached to the second detachable stub on the back side of the page.

9. The assembly of claim 8, wherein the second page further comprises:

a front side, a back side, a first detachable stub attached to a first edge of the body by a first detachment line, a second detachable stub attached to a second edge of the body opposite the first edge by a second detachment line; and wherein the back side of the second page is attached to the front side of the page by a second adhesive glue placement attaching the first detachable stub of the page to the first detachable stub of the second page and a third adhesive glue placement attaching the second detachable stub of the page to the second detachable stub of the second page.

10. The assembly of claim 9, wherein the second page comprises information visible looking through a transparent surface when the form assembly is attached to the transparent surface.

11. The assembly of claim 8, wherein the second page further comprises:

a front side, and a back side, wherein the back side of the second page is attached to front side of the page by the first adhesive glue placement.

12. A form assembly for removably attaching a form to a surface comprising:

the form comprising a page, the page comprising:

a body, a first detachable stub attached to a first edge of the body by a first detachment line, a second detachable stub attached to a second edge of the body opposite the first edge by a second detachment line;

a first adhesive label comprising:

an adhesive layer comprising a lite-tac adhesive, a liner layer removably covering a portion of the lite-tac adhesive of the adhesive layer, an exposed lite-tac adhesive portion of the adhesive layer not covered by the liner layer, wherein the first adhesive label and the exposed lite-tac adhesive are aligned with the first detachable line such that the aligned portion of the first adhesive label is attached to the first detachable stub by the aligned and exposed lite-tac adhesive portion of the adhesive layer, wherein the exposed lite-tac adhesive portion of the lite-tac adhesive layer does not overlap the first detachment line;

a second adhesive label comprising:

an adhesive layer comprising a lite-tac adhesive, a liner layer removably covering a portion of the lite-tac adhesive of the adhesive layer, an exposed lite-tac adhesive portion of the adhesive layer not covered by the liner layer, wherein the second adhesive label and the exposed lite-tac adhesive are aligned with the second detachment line such that the aligned portion of the second adhesive label is attached to the second detachable stub by the aligned and exposed lite-tac adhesive portion of the adhesive layer, wherein the exposed lite-tac adhesive portion of the lite-tac adhesive layer does not overlap the second detachment line; and a second page comprising a body, wherein the second page is attached to the page by a first adhesive glue placement attaching the body of the page to the body of the second page, and wherein an entirety of the first adhesive glue placement is disposed just below the first detachment line and between the first detachment line and the second detachment line;

wherein removing the liner layer of the first adhesive label and the liner layer of the second adhesive exposes the covered portion of the lite-tac adhesive of the first adhesive label and the lite-tac adhesive of the second adhesive label, and wherein the lite-tac adhesive of the first adhesive label and the lite-tac adhesive of the second adhesive label are adapted to removably secure the form assembly to a surface, and to leave little adhesive residue on the surface when the form assembly is removed.

13. The assembly of claim 12, wherein the second page further comprises:

a first detachable stub attached to a first edge of the body by a first detachment line, a second detachable stub attached to a second edge of the body opposite the first edge by a second detachment line; and wherein the second page is attached to the page by a second adhesive glue placement attaching the first detachable stub of the page to the first detachable stub of the second page and a third adhesive glue placement attaching the second detachable stub of the page to the second detachable stub of the second page.

14. The assembly of claim 12, wherein the first edge is a top edge of the body, and the second edge is a bottom edge of the body.

15. The assembly of claim 12, wherein the first edge is a left edge of the body, and the second edge is a right edge of the body.

16. The assembly of claim 12, wherein the page further comprises a third detachable stub attached to a third edge of the body by a third detachment line; and a third adhesive label comprising:

an adhesive layer comprising a lite-tac adhesive, a liner layer removably covering a portion of the lite-tac adhesive of the adhesive layer, an exposed lite-tac adhesive portion of the adhesive layer not covered by the liner layer, the third adhesive label attached to the third detachable stub by the exposed lite-tac adhesive portion of the adhesive layer, wherein the exposed lite-tac adhesive portion of the lite-tac adhesive layer does not overlap the third detachment line.

17. The assembly of claim 12, wherein the body of the page is wholly detachable from the first detachable stub and the second detachable stub after the form assembly is attached to the surface, and wherein the body of the page and the body of the second page remain attached by the first adhesive glue placement when the body of the page is wholly detached from the first detachable stub and the second detachable stub.

18. A form assembly for removably attaching a form to a surface comprising:

a form comprising a page, the page comprising a body, a first detachable stub on a first edge and a second detachable stub on a second edge opposite the first edge;

a first adhesive label comprising lite-tac adhesive attached to the first detachable stub without overlapping a first detachment line, wherein the first adhesive label and the lite-tac adhesive are aligned with the first detachment line;

a second adhesive label comprising a lite-tac adhesive attached to the second detachable stub without overlapping a second detachment line, wherein the second adhesive label and the lite-tac adhesive are aligned with the second detachment line; and wherein the first adhesive label and the second adhesive label are adapted to removably attach the form assembly to a surface, and to leave little adhesive residue on the surface when the form assembly is removed; and a second page comprising a body, wherein the second page is attached to the page by a first adhesive glue placement attaching the body of the page to the body of the second page, and wherein an entirety of the first adhesive glue placement is disposed just below the first detachment line and between the first detachment line and the second detachment line.

19. The assembly of claim 18, wherein the body of the page is wholly detachable from the first detachable stub and the second detachable stub after the form assembly is attached to the surface, and wherein the body of the page and the body of the second page remain attached by the first adhesive glue placement when the body of the page is wholly detached from the first detachable stub and the second detachable stub.

20. The assembly of claim 18, wherein the second page further comprises a first detachable stub on a first edge and a second detachable stub on a second edge opposite the first edge, wherein the second page is attached to the page by a second adhesive glue placement attaching the first detachable stub of the page to the first detachable stub of the second page and a third adhesive glue placement attaching the second detachable stub of the page to the second detachable stub of the second page.

21. A method of assembling a form assembly for removably attaching a form to a surface comprising:

kisscutting a liner of a first adhesive label to create a first portion and a second portion of the liner;

kisscutting a liner of a second adhesive label to create a first portion and a second portion of the liner;

removing the first portion of the liner of the first adhesive label to expose a first portion of lite-tac adhesive on the first adhesive label;

removing the first portion of the liner of the second adhesive label to expose a first portion of lite-tac adhesive on the second adhesive label;

aligning the first adhesive label and the first portion of lite-tac adhesive thereon with a first detachment line of a first detachable stub and attaching the aligned portion of the first adhesive label to the first detachable stub of a page so that the first portion of lite-tac adhesive of the first adhesive label does not overlap the first detachment line;

aligning the second adhesive label and the first portion of lite-tac adhesive thereon with a second detachment line of a second detachable stub and attaching the aligned portion of the second adhesive label to the second detachable stub of the page so that the first portion of the lite-tac adhesive of the second adhesive label does not overlap the second detachment line;

wherein the lite-tac adhesive is adapted to removably secure the adhesive labels to a surface, and to leave little adhesive residue on the surface when the adhesive labels are removed; and attaching a to the page, wherein the second page is attached to the page by a first adhesive glue placement attaching a body of the page to a body of the second page, and wherein an entirety of the first adhesive glue placement is disposed just below the first detachment line and between the first detachment line and the second detachment line.

22. The method of claim 21, further comprising removing the second portion of the liner from the first adhesive label and the second portion of the liner from the second adhesive label.

23. The method of claim 21, wherein the second page is attached to the page such that when the form assembly is attached to the surface the second page is held in between the page and the surface.

* * * * *

UNITED STATES PATENT AND TRADEMARK OFFICE

CERTIFICATE OF CORRECTION

PATENT NO. : 8,474,165 B1
APPLICATION NO. : 12/271205
DATED : July 2, 2013
INVENTOR(S) : Agostino S. Hill et al.

It is certified that error appears in the above-identified patent and that said Letters Patent is hereby corrected as shown below:

In the Claims

Claim 21, column 14, line 41

"and attaching a to the page"

should read

"and attaching a second page to the page"

Signed and Sealed this
Fifteenth Day of October, 2013

Teresa Stanek Rea

Teresa Stanek Rea
*Deputy Director of the United States Patent and Trademark Office*